US007111955B2

(12) United States Patent
Tsai et al.

(10) Patent No.: US 7,111,955 B2
(45) Date of Patent: Sep. 26, 2006

(54) ILLUMINATED LOGO UNIT WITH REFLECTIVE FILM

(75) Inventors: Ming-Chiang Tsai, Tu-Chen (TW); Chun Yu Lee, Tu-Chen (TW); Tsung-Wei Jiang, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 107 days.

(21) Appl. No.: 10/890,050

(22) Filed: Jul. 12, 2004

(65) Prior Publication Data

US 2005/0007752 A1 Jan. 13, 2005

(30) Foreign Application Priority Data

Jul. 11, 2003 (TW) ..... 92119080 A

(51) Int. Cl.
*F21V 21/08* (2006.01)

(52) U.S. Cl. ..... 362/103; 362/806

(58) Field of Classification Search ..... 362/29, 362/806, 186, 298, 103, 346
See application file for complete search history.

(56) References Cited

U.S. PATENT DOCUMENTS 6,174,075 B1 1/2001 Fuwausa
6,595,667 B1 * 7/2003 Obata ..... 362/489
6,811,278 B1 * 11/2004 Sung ..... 362/84
2002/0001183 A1 * 1/2002 Shigehiro ..... 362/23
2005/0007751 A1 * 1/2005 Tsai ..... 362/23

FOREIGN PATENT DOCUMENTS

JP 09-159493 6/1997

* cited by examiner

*Primary Examiner*—Renee Luebke
*Assistant Examiner*—Julie A. Shallenberger
(74) *Attorney, Agent, or Firm*—Wei Te Chung

(57) ABSTRACT

An illuminated logo unit (300) includes a reflective board (320), a pattern panel (301), an illuminating device (310), and a reflective film (305). The pattern panel is arranged over the reflective board, and the reflective film is disposed under the pattern panel opposite to the reflective board. Much light emanating from the illuminating device is reflected more than once by the reflective film and the reflective board before it reaches the pattern panel. This enhances the overall brightness and uniformity of light beams of the illuminated logo unit. Even at night, the illuminated logo unit can be clearly viewed. The illuminated logo unit may be used for applications such as in a billboard, a logo displayed on a vehicle, and so on.

11 Claims, 2 Drawing Sheets

ILLUMINATED LOGO UNIT WITH REFLECTIVE FILM

BACKGROUND OF THE INVENTION

1. Field of the Invention

The present invention relates to logo units used for displaying images such as for advertising, and particularly to an electrically illuminated logo unit.

2. Description of the Prior Art

A conventional logo unit, such as a registration mark on a billboard or an insignia on a vehicle, cannot illuminate itself. If the image of the logo unit is to be clearly seen at night, it must be illuminated by an external source. However, external illumination has various inherent limitations, including the angle of illumination, the brightness of the source, and the reflective ratio of the logo unit. These limitations frequently result in the logo unit being unevenly illuminated. Furthermore, the brightness and overall aesthetic display of the logo unit may be unsatisfactory.

Generally, to solve the above-described problems, an active light source is arranged at the back of the logo unit. A logo unit having an active light source arranged at the back thereof is known as an illuminated logo unit.

A conventional illuminated logo unit as disclosed in U.S. Pat. No. 6,174,075 is represented in FIGS. 3 and 4. The illuminated logo unit 1 includes a pattern body 12, a frame 16 arranged around a periphery of the pattern body 12, and a dot light source 101 arranged at the back of the pattern body 12. The pattern body 12 is elliptical, and includes a pattern 121, a top surface 17, a cavity 18, and a bottom surface 19. The pattern 121 defines a projection surface (not labeled) on the bottom surface 19. The cavity 18 is defined between the top surface 17 and the bottom surface 19. The dot light source 101 is a light emitting diode (LED), and is secured in the cavity 18. In particular, the dot light source 101 is arranged at a center of the projection surface defined on the bottom surface 19.

Because the dot light source 101 is arranged at the center of the projection surface, the distribution of light energy over the whole projection surface from the dot light source 101 is uneven. For example, a central circular area 100 on the pattern body 12 receives much more light energy from the dot light source 101 than other portions of the pattern body 12. Accordingly, a brightness of the pattern 121 is not uniform. The result is that the overall pattern 121 cannot be clearly seen at night.

SUMMARY OF THE INVENTION

An object of the present invention is to provide an illuminated logo unit which has high brightness and uniformity of illumination.

In order to achieve the object set forth, an illuminated logo unit of the present invention includes a reflective board, a pattern panel, an illuminating device, and a reflective film. The pattern panel is arranged over the reflective board, and the reflective film is disposed under the pattern panel opposite to the reflective board.

In the exemplary embodiment of the present invention, the illuminated logo unit includes the reflective board and the reflective film. Therefore much light emanating from the illuminating device is reflected more than once by the reflective film and the reflective board before it reaches the pattern panel. This enhances the overall reflectivity and utility of light beams of the illuminated logo unit. It also enhances uniform distribution of light energy over the whole surface of the pattern panel, so that an overall brightness of the illuminated logo unit is improved. Even at night, the illuminated logo unit can be clearly viewed. The illuminated logo unit may be used for applications such as in a billboard, a logo displayed on a vehicle, and so on.

Other objects, advantages and novel features of the invention will become more apparent from the following detailed description when taken in conjunction with the accompanying drawings.

DETAILED DESCRIPTION OF THE INVENTION

Figure 1:
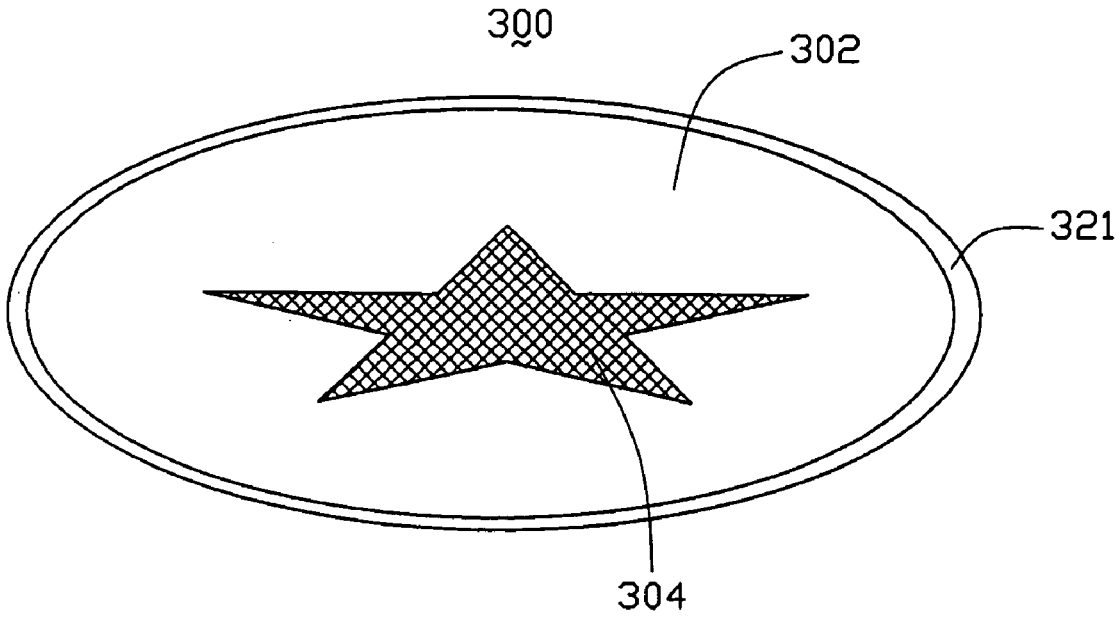
FIG. 1 is a schematic, isometric view of an illuminated logo unit according to an exemplary embodiment of the present invention.
Figure 2:
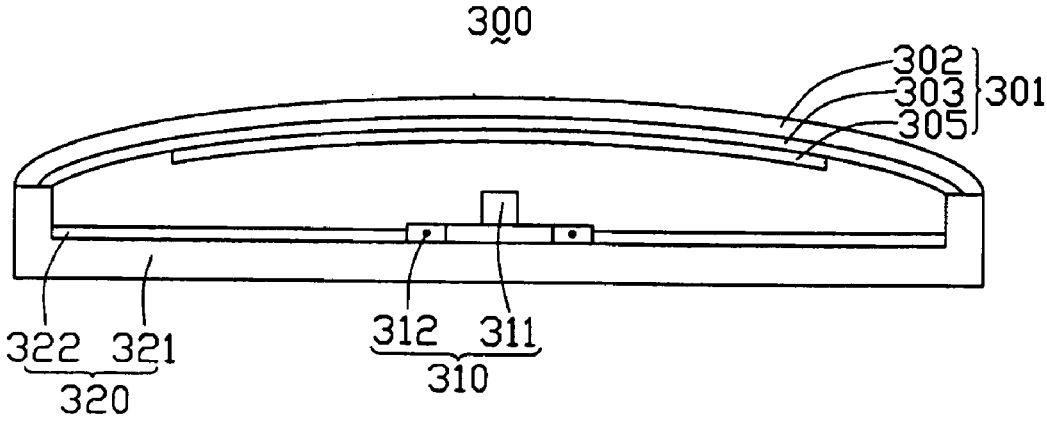
FIG. 2 is a schematic, cross-sectional view of the illuminated logo unit of FIG. 1, showing an inner configuration thereof.
Figure 3:
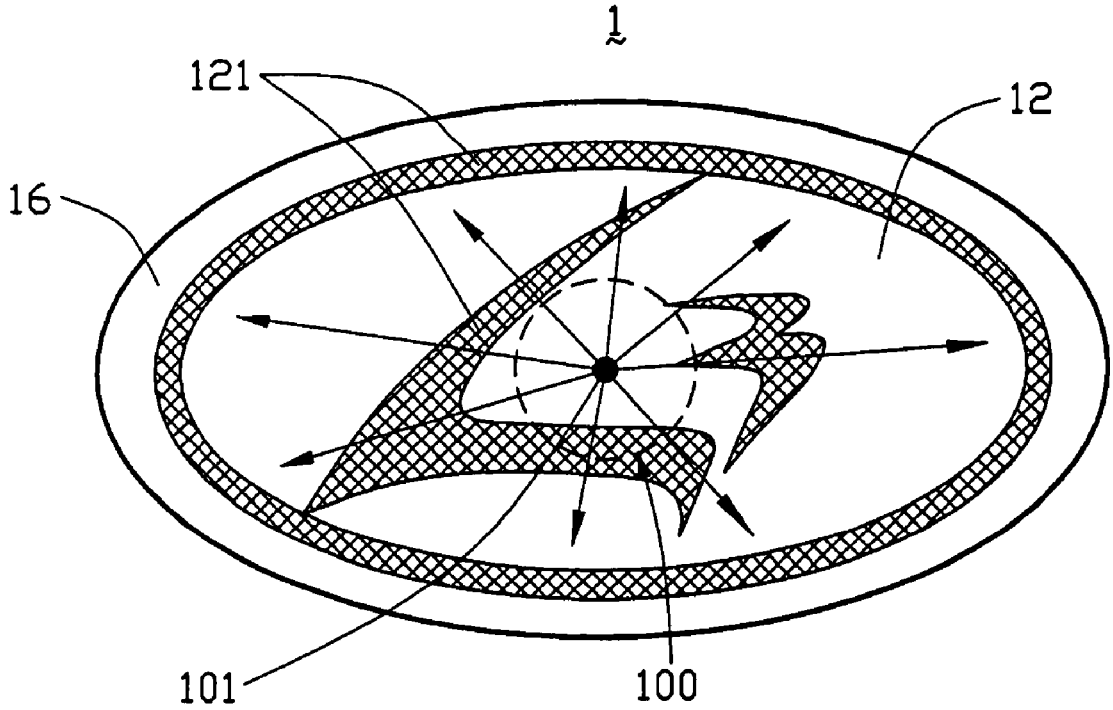
FIG. 3 (PRIOR ART)
FIG. 3 is a schematic, isometric view of a conventional illuminated logo unit, showing light paths thereof.
Figure 4:
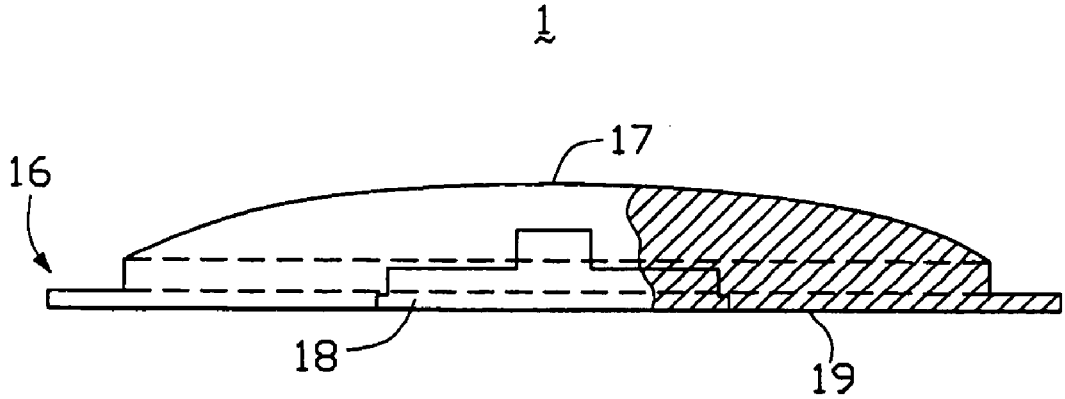
FIG. 4 (PRIOR ART)
FIG. 4 is a schematic, side cross-sectional view of the illuminated logo unit of FIG. 3, showing an inner configuration thereof.

Referring to FIGS. 1 and 2, an illuminated logo unit 300 in accordance with the exemplary embodiment of the present invention is generally elliptical, and includes a pattern panel 301, an illuminating device 310 and a reflective board 320. The pattern panel 301 is made of a soft material, and is arranged over the reflective board 320. The pattern panel 301 may alternatively be made of a hard material, and be fixed on the reflective board 320 by a frame or a fastener.

The pattern panel 301 includes a transparent body 302, a scattering layer 303, a reflective film 305, and a pattern 304. The transparent body 302 is used to protect the pattern 304 from becoming worn or damaged, and is made from a highly transparent material in order to allow maximum transmission of light. Alternatively, if the need for transparency is not paramount or if the pattern panel 301 does not incorporate a scattering layer 303, the transparent body 302 may be made from a translucent material instead. Further, for enhancing the chroma and displaying multi-color images, the transparent body 302 can be made of different colored materials. In order to avoid leakage of light, a circumferential sidewall of the transparent body 302 is reflective. The scattering layer 303 is disposed under the transparent body 302, and diffuses the light received from the illuminating device 310. The scattering layer 303 is formed by mechanical processing or chemical etching of the transparent body 302 itself. The reflective film 305 is disposed under the pattern panel 301, opposite to the reflective board 320. The reflective film 305 can be made of a high reflectivity metal, particularly aluminum or silver. The pattern 304 is attached between the scattering layer 303 and the reflective film 305.

The reflective board 320 includes a substrate 321, and a reflective plate 322 disposed on the substrate 321. The illuminating device 310 is arranged at a center of the reflective board 320.

The illuminating device 310 includes a light source 311 and a driving circuit 312. The light source 311 is an LED, an Organic Light Emitting Diode (OLED), a luminescent doped material, or a luminescent plastic. The position of the light source 311 is determined according to need. The driving circuit 312 provides a driving voltage for the light source 311. In alternative embodiments, two or more light sources 311 may be used.

In the exemplary embodiment of the present invention, the illuminated logo unit 300 includes the reflective board 320 and the reflective film 305. Therefore much light emanating from the illuminating device 310 is reflected more than once by the reflective film 305 and the reflective board 320 before it reaches the pattern panel 301. This enhances the overall reflectivity and utility of light beams of the illuminated logo unit 300. It also enhances uniform distribution of light energy over the whole surface of the pattern panel 301, so that an overall brightness of the illuminated logo unit 300 is improved. Even at night, the illuminated logo unit 300 can be clearly viewed.

The illuminated logo unit 300 may be used for applications such as in a billboard, a logo displayed on a vehicle, and so on. For example, if the illuminated logo unit 300 is used as a logo displayed on a vehicle, an electrical input terminal (not shown) of the illuminated logo unit 300 can be connected with an output terminal of a battery of the vehicle. That is, the energy needed by the illuminated logo unit 300 can be supplied by a general power supply of the vehicle itself.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An illuminated logo unit, comprising:

a reflective board;

an illuminating device arranged on the reflective board for providing light; and a pattern panel disposed above and corresponding to the reflective board, the pattern panel comprising:

a transparent body having a body undersurface, the body undersurface having a center part and a peripheral part enclosing the center part; and a reflective film covering the center part of the body undersurface for reflecting light incident thereon back to the reflective board, the peripheral part of the body undersurface being exposed and thereby configured for allowing light incident thereon to pass therethrough.

2. The illuminated logo unit of claim 1, wherein the transparent body is made of a transparent material.

3. The illuminated logo unit of claim 1, wherein the transparent body has a reflective circumferential sidewall.

4. The illuminated logo unit of claim 1, wherein the transparent body comprises a colored material.

5. The illuminated logo unit of claim 1, wherein the pattern panel further comprises a scattering layer disposed between the transparent body and the reflective film.

6. The illuminated logo unit of claim 5, wherein the scattering layer is formed by mechanical processing or chemical etching of the transparent body.

7. The illuminated logo unit of claim 1, wherein the illuminating device comprises a light source and a driving circuit.

8. The illuminated logo unit of claim 7, wherein the light source comprises any one or more of a light emitting diode, an organic light emitting diode, a luminescent doped material, and a luminescent plastic.

9. The illuminated logo unit of claim 1, wherein the pattern panel further comprises a logo pattern attached between the transparent body and the reflective film.

10. An illuminated logo unit, comprising:

a reflective board;

a pattern panel spaced from the reflective board, comprising:

a transparent body;

a reflective film disposed on an undersurface of the transparent body opposite to the reflective board; and a logo pattern positioned between the transparent body and the reflective film; and an illuminating device located between the pattern panel and the reflective board.

11. An illuminated logo unit, comprising:

a reflective board;

a pattern panel spaced from the reflective board, the pattern panel comprising:

a transparent body;

a scattering layer coated upon the transparent body;

a logo pattern attached on an undersurface of the scattering layer; and a transparent protective layer coated upon the scattering layer; and an illuminating device located between the pattern panel and the reflective board.

* * * * *